US005209584A

United States Patent [19]

Galarneau

[11] Patent Number: 5,209,584

[45] Date of Patent: May 11, 1993

[54] DEVICE FOR USE IN BRAILLE PRINTING OR PAPERLESS BRAILLE COMMUNICATION

[76] Inventor: Roland Galarneau, 48 Brady Street, Hull, Quebec, Canada, J8Y 5L4

[21] Appl. No.: 732,627

[22] Filed: Jul. 19, 1991

[30] Foreign Application Priority Data

Mar. 1, 1991 [CA] Canada ..... 2037388

[51] Int. Cl.[5] ..... B41J 3/12

[52] U.S. Cl. ..... 400/122; 101/18

[58] Field of Search ..... 400/121, 122; 101/18

[56] References Cited

U.S. PATENT DOCUMENTS

| | | | |
|---|---|---|---|
| 3,254,750 | 6/1966 | Goldner | 400/122 |
| 3,823,804 | 7/1974 | Lokey | 400/122 |
| 4,183,683 | 1/1980 | Hiratsuka et al. | 400/122 |
| 4,261,663 | 4/1981 | Grimnes | 400/122 |
| 4,653,942 | 3/1987 | Soloveychik et al. | 400/122 |
| 4,735,516 | 4/1988 | Galarneau | 101/18 |
| 4,930,914 | 6/1990 | Hulterstrum et al. | 400/122 |

FOREIGN PATENT DOCUMENTS

| | | | |
|---|---|---|---|
| 0041287 | 3/1980 | Japan . | |
| 7802332 | 9/1979 | Netherlands | 400/122 |

*Primary Examiner*—Edgar S. Burr
*Assistant Examiner*—Ren Yan
*Attorney, Agent, or Firm*—Spensley, Horn, Jubas & Lubitz

[57] ABSTRACT

A device for forming Braille characters for tactile sensation or impression onto an embossable substrate includes a substantially block-like main body. At least one array of six Braille printing pins is contained in the block in a 2×3 Braille cell configuration. Each said pin is contained in a first cylindrical bore and is movable between a retracted position whereby it does not protrude from the block, and an extended position whereby the tip of the pin protrudes from the block. Means are associated with each said pin for maintaining each pin in an extended position.

8 Claims, 3 Drawing Sheets

DEVICE FOR USE IN BRAILLE PRINTING OR PAPERLESS BRAILLE COMMUNICATION

The present invention relates to the field of Braille communication. In particular, the present invention provides a Braille communications device suitable for use in a Braille printer or as a paperless Braille device.

Braille printers use devices for embossing Braille characters onto heavy gauge paper. Each character or symbol in the Braille alphabet is represented by a unique combination of raised dots in a two wide by three high Braille cell. These dots are conventionally embossed onto a piece of paper in one of two ways. The more traditional way is by the use of embossing dies arranged in a manner of a typewriter. As each character of a word is to be embossed, the appropriate die is pressed against a paper substrate behind which is situated a template having indentations aligned with the dots of a six-dot Braille cell. The disadvantage of this form of printer is a very large number of unique dies must be provided, one for each character. Each must be moved from a resting area to the paper and then moved away for the printing of a single character. It will therefore be appreciated that this form of printing is quite slow. It is also quite expensive, since these dies are expensive. Moreover, it is a very noisy way to print, as the dies are swung onto the template from their holding area with considerable force.

More recently, Braille printers have been developed utilizing computer technology. These use printing heads exemplified by the printer head shown in Applicant's U.S. Pat. No. 4,735,516. In this form of printer, a row of solenoid driven printing pins are moved back and forth across a paper substrate, embossing individual Braille dots in a line of Braille characters. The paper substrate is advanced incrementally after each pass of the printing head, so that after three passes, a line of Braille characters will be fully embossed. This form of printing, while also expensive, is very fast. However, it remains expensive, and is fairly noisy. Also, it consumes a considerable amount of power, so it is suitable for stationary applications primarily.

The object of the present invention is to provide a fairly low cost device for use in Braille printing. A further object is to provide such a device that will be less noisy than devices currently in use. Another object of the present invention is to provide such a device that is also adaptable for paperless Braille communication.

In a broad aspect, the present invention relates to a device for forming Braille characters for tactile sensation or impression onto an embossable substrate including: i) a substantially block-like main body; ii) at least one array of six Braille printing pins contained in said block in a 2×3 Braille cell configuration, each said pin being contained in a first cylindrical bore and being movable between a retracted position whereby said pin does not protrude from said block, and an extended position whereby the tip of said pin protrudes from said block; and iii) means associated with each said pin for maintaining each said pin in an extended position.

In drawings that illustrate the present invention by way of example:

Figure 1:
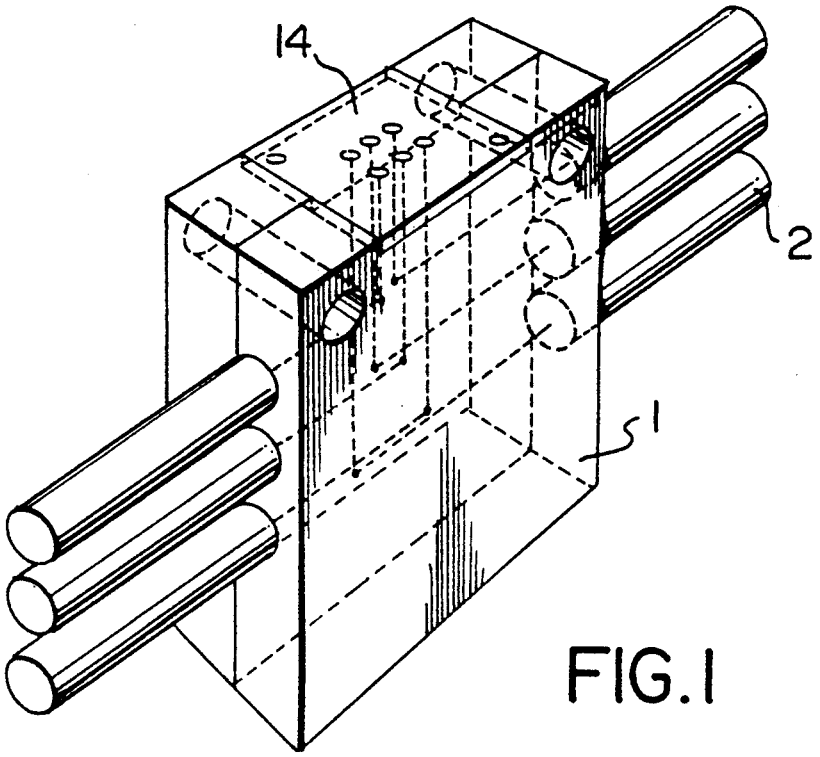
FIG. 1 is a perspective view of a Braille print head according to the present invention.
Figure 2:
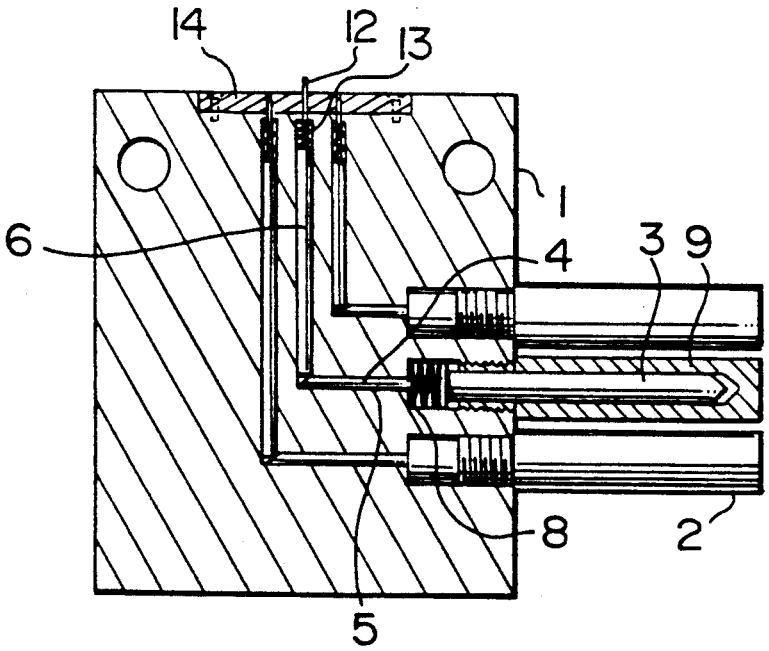
FIG. 2 is a cross sectional view of the printhead of of FIG. 1.
Figure 3:
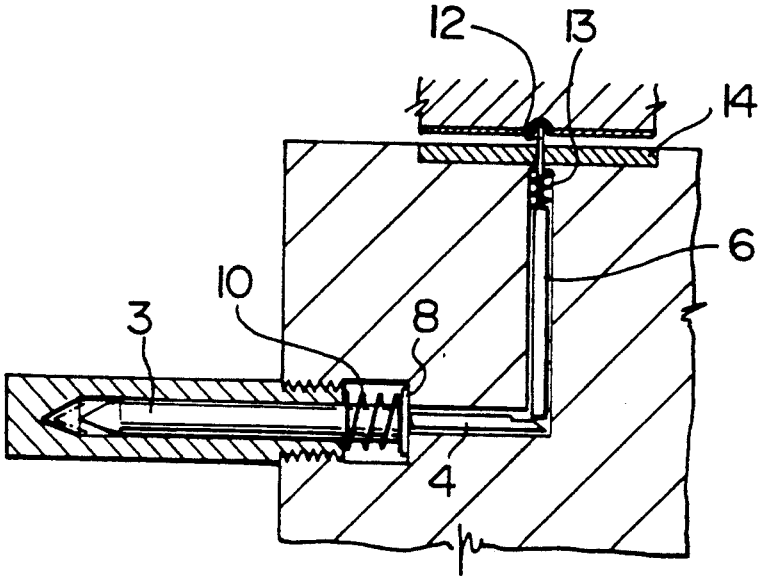
FIG. 3 is a detail view of the junction between a solenoid and a rod which is mounted to a Braille printing pin in the printing head of FIG. 1.
Figure 4:
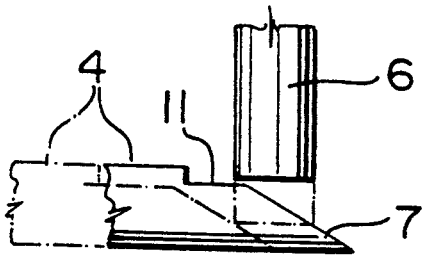
FIG. 4 is a further detail of the solenoid and rod illustrated in FIG. 3.

Referring now to the drawings, it will be seen that each printing head 1 comprises a block on which are mounted six solenoids 2. The plunger 3 of each solenoid 2 terminates in a rod 4 which is withdrawn, as the solenoid is electrically activated, through a bore 5, away from a second rod 6 that extends transversely from the end of rod 4 on the solenoid.

Rod 4 extending from the solenoid terminates in a profiled cam surface 7 having an inclination of about 30° from the horizontal (given the direction of rod 4 as horizontal). Where rod 4 is joined to the end of solenoid plunger 3, there is provided a radially outwardly extending flange 8. Between flange 8 and the inner end of the cylinder 9 of the solenoid 2, there is a spring 10 which exerts force against cylinder 9 and flange 8 to press rod 4 to the end of bore 5 except when the solenoid is activated. Immediately adjacent cam surface 7 on rod 4 in a flat surface 11 on which the second rod 6 rests when rod 4 is in its forward position. When the solenoid 2 is activated, then, rod 4 will be withdrawn, and rod 6 will slide down cam surface 7. The extent of withdrawal of rod 4 is selected to permit rod 6 to slide down far enough so as to retract from the upper surface of block 1 a Braille printing pin 12 extending co-axially upwardly from the upper end of rod 6.

Between the upper end of rod 6 and the upper surface of the block 1, there is a compression spring 13 bearing against the rod 6 to press it downwardly. The upper end of the spring 13 bears against a plate 14 which is screwed to the upper surface of the block. Plate 14 is apertured with six holes arranged in the shape of a Braille cell. Plate 14 may be removed for maintenance purposes, for instance to replace worn printing pins 12.

It will be observed that three complete arrangements of solenoid, horizontal rod, vertical rod and printing pin are provided on each side of the block 1, to yield a total of six printing pins—enough to print a Braille character. Because of the size of a solenoid, the solenoids are arranged on three levels, with the top solenoid being provided for the printing pin closest to the side of the block from which the solenoid extends, and the bottom solenoid being operatively connected to the pin furthest therefrom in the vertical row of pins.

The solenoids are electrically connected to a driver board receiving signals from a CPU. For each character to be formed by the array of six printing pins on a block, all six solenoids are simultaneously fed a signal, either to retract or to remain stationary. Those solenoids which retract will cause their associated Braille pin to retract. The particular combination of unretracted pins remaining will form a Braille character.

The Braille character forming device described above may be utilized in two distinct ways: as a paperless Braille communication device, or in a Braille printing device as a printing head.

In its first mode of utilization, as a paperless communication device, one or more blocks, connected to a suitable electronic driver, are provided with the plate 14 on their upper surface accessible by the fingertips of a person. Communication of information via the device is then possible by operating the device to form one character (or series of characters) after another at a desired speed. The characters are sensed by the fingertips of the person using the device as they are formed. A device of this kind may be connected, in a manner that will be possible for one skilled in the art, to an optical scanner, so that visually readable characters may be converted directly to tactile Braille characters. In this way, it is not necessary to prepare a Braille text of a visually readable text for a person to read the text in Braille.

Figure 5:
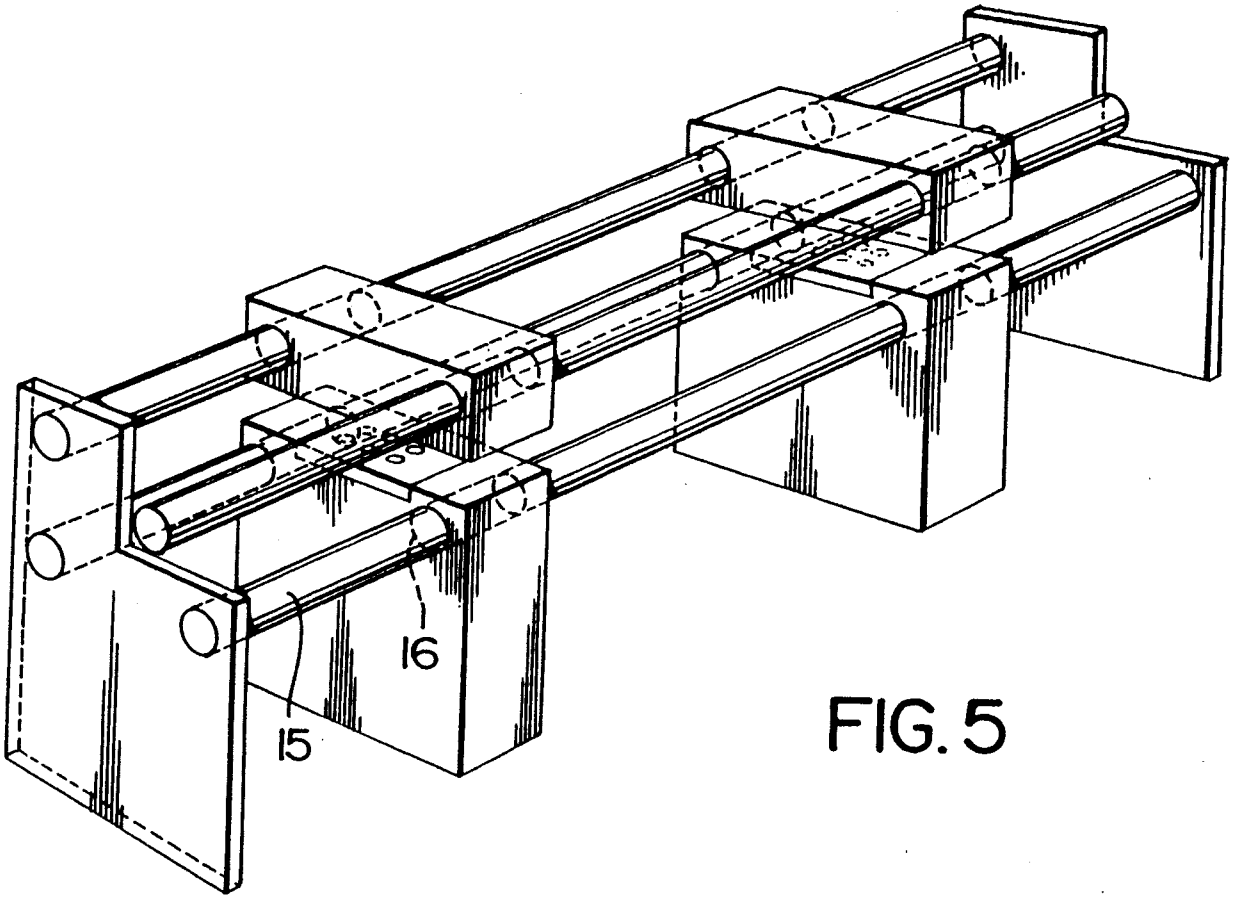
FIG. 5 is a perspective view of an assembly of two printing heads on a track.

Alternately, the device of the present invention may be utilized for form a novel printing mechanism for a Braille printer. With reference to FIG. 5, it will be seen that one or more printing head blocks 1 of the present invention may be mounted on a pair of rails 15 which may be cylindrical shafts which pass through apertures 16 on the blocks. The apertures may be provided with suitable friction reducing bushings. The blocks are movable back and forth across a printing area that will correspond to the width of a piece of standard Braille printing paper. A suitable means of moving the block or blocks across the page would be a stepper motor connected by a belt drive to the block or blocks. Alternatively, one of the shafts on which the blocks are mounted may be threaded and engagable with corresponding threads in the aperture of the blocks through which is passes. Rotation of such a threaded shaft will move the block.

Located immediately above the blocks, on a similar set of two shafts, one of which may be similarly threaded, are embossers, which are solid blocks having a pattern of indentations on their surface facing the said printing blocks, of six Braille dots. This pattern of indentations is aligned with the pattern of Braille pins on the print blocks. Moreover, one of the two shafts on which the embossers is mounted is fixed, and one is movable. The said fixed shaft acts as a hinge about which the embosser may pivot to be moved. The other shaft is affixed at each end to a fairly powerful solenoid, whereby actuation of the solenoids on which the movable shaft is mounted will cause the embosser to move against the print blocks and emboss Braille characters. In operation then, Braille is printed as follows:

i) a conventional paper feed, which may be a tractor feed or a rubber roller moves a piece of embossable Braille printing paper into position, so that it is between the print blocks and embossers;
ii) the solenoids in the print blocks are the appropriate Braille characters in the pins projecting therefrom;
iii) the solenoids supporting the embossers are activated to press the embossers against the print blocks and form characters;
iv) the solenoids in the blocks are activated;
v) the print blocks and embossers, which remain aligned at all times, are then moved over to form the next character, until a row of characters is formed;
vi) the paper is then advanced one row of characters;
vii) a new row of characters is then formed, in the manner described above, and the process continues, until a page of characters is formed.

It will be understood that utilizing the appropriate software, printing may proceed in a back and forth motion so it is not necessary to move the print blocks and embossers all the way to a starting position on the left before each line of print.

It is to be understood that the examples described above are not meant to limit the scope of the present invention. It is expected that numerous variants will be obvious to the person skilled in the design of Braille printing apparatus, without any departure from the spirit of the present invention. The appended claims, properly construed, form the only limitation upon the scope of the present invention.

I claim:

1. A device for forming Braille characters for tactile sensation or impression onto an embossable substrate including:

i) a substantially block-like main body having a flat upper surface, said main body being elongated in the direction beneath said upper surface, said body being provided with an array of first cylindrical bores extending downwardly from said upper surface, each said first bore having a lower end which is remote from said upper surface, and with an array of second cylindrical bores, each said second bore being associated with a respective first bore, extending transversely to the associated first bore and intersecting the lower end of the associated first bore;
ii) at least one array of six Braille printing pins contained in said body in two parallel rows each having three pins to constitute a $2\times3$ Braille cell, each said pin having a tip and being contained in a respective first cylindrical bore and being movable between a retracted position whereby said pin does not protrude from said body, and an extended position whereby the tip of said pin protrudes from said upper surface of said body;
iii) a plurality of means each associated with a respective pin for maintaining the respective pin in an extended position, each said means (iii) comprising a first rod movable in a respective second bore to a position beneath said pin to push said pin to its extended position and hold it there;
iv) an array of second rods, each said second rod being disposed in a respective first bore for movement along the respective first bore and having a lower end which is directed toward the lower end of the respective first bore and an upper end which is directed away from the lower end of the respective first bore, wherein each said second rod has a larger diameter than each said pin and each said pin extends co-axially upwardly and outwardly from said upper end of a respective second rod;
v) a flat plate secured against said upper surface of said main body and provided with an array of apertures aligned with said first bores so that each said pin extends through a respective aperture at least when said pin is in the extended position; and
vi) a plurality of springs each located in a respective first bore and extending from said upper end of a respective second rod, around a respective pin and against said flat plate;

wherein each said first rod comprises a flat, ramp-like cam surface that bears against the lower end of a respective second rod, whereby forward motion of said first rod causes said second rod to move up.

2. A device as claimed in claim 1 wherein each said means associated with a respective pin further comprise:

an electrically activatable solenoid having a plunger of greater diameter than a respective first rod, said plunger being linked co-axially with the respective first rod; and a second spring provided in the respective second bore and bearing against said plunger, wherein activation of said solenoid causes forward motion of the respective first rod and upon deactivation of said solenoid, said second spring pushes said respective first rod and said plunger away from a respective second rod.

3. A device as claimed in claim 2, wherein three respective solenoids are associated with each said row of pins in said cell and are aligned in a stacked relationship, whereby said first rods associated with each said row of pins are parallel to each other but on different vertical levels in said body.

4. A device as claimed in claim 3, wherein for each row of said Braille cell, the first rod associated with the pin of that row which is furthest from said stacked solenoids is located in the lowermost position in said body and the second rod associated with the pin of that row which is furthest from said stacked solenoids has a correspondingly long dimension.

5. A device as claimed in claim 4, further comprising:

a first rail on which said body is mounted for movement relative to said first rail parallel to a substrate to be embossed with Braille characters;

a second rail;

a template mounted on said second rail for movement relative to said second rail parallel to the substrate to be embossed, said template having a Braille cell of dots formed as impressions in said template, said impressions being aligned with said pins and said template being positioned relative to said body to enable the substrate to be disposed between said body and said template, and said body and said template being movable in unison along the respective rails.

6. A device as claimed in claim 5, further comprising a C.P.U. for driving said solenoids to form predetermined combinations of desired Braille characters to be sensed in a tactile manner as words or symbols.

7. A device as claimed in claim 8, wherein said template is mounted in a pivoting manner on said rail, and means are provided to press said template toward said main body, thereby to emboss a Braille character on a substrate between said template and said device.

8. A device as claimed in claim 7, wherein said solenoids of said device, the movement of said main body and template on said rails, and the movement of said template toward said main body, are all driven by said C.P.U. to sequentially form Braille characters on a substrate.

* * * * *